US005217419A

United States Patent [19]

Harwood

[11] Patent Number: 5,217,419

[45] Date of Patent: Jun. 8, 1993

[54] WALK-THROUGH WALKER

[76] Inventor: Edward N. Harwood, 103 Ivy, Henderson, Nev. 89015

[21] Appl. No.: 587,002

[22] Filed: Sep. 24, 1990

[51] Int. Cl.[5] ..... A63B 22/10; A63B 22/00

[52] U.S. Cl. ..... 482/66; 482/52; 135/65; 135/69

[58] Field of Search ..... 272/70, 70.1, 70.3; 135/65, 66, 67, 71, 68, 69; D21/191; 297/4

[56] References Cited

U.S. PATENT DOCUMENTS

| | | | |
|---|---|---|---|
| D. 114,912 | 11/1938 | Upton . | |
| D. 188,784 | 9/1960 | Campbell . | |
| D. 208,607 | 9/1967 | Williams . | |
| D. 216,288 | 12/1969 | Murcott . | |
| 257,185 | 5/1882 | Price . | |
| D. 291,791 | 9/1987 | Bean . | |
| D. 327,106 | 2/1990 | Clark | D21/191 |
| 931,394 | 8/1909 | Day | 272/69 |
| 1,628,949 | 3/1926 | Catherine . | |
| 2,626,652 | 10/1949 | Steigler . | |
| 2,723,855 | 11/1955 | McKee | 272/114 |
| 2,785,731 | 5/1954 | Welsh . | |
| 2,899,968 | 8/1959 | Reichenbach | 135/65 |
| 3,280,831 | 10/1966 | Parker | 272/70.3 |
| 3,414,323 | 12/1968 | Mitchum | 297/4 |
| 3,690,652 | 9/1972 | Schneider | 135/67 |
| 4,027,687 | 6/1977 | McGowan | 135/68 |
| 4,135,535 | 1/1979 | Thomas | 272/70.3 X |
| 4,411,283 | 10/1983 | Lucarelli . | |
| 4,733,682 | 3/1988 | Ellena | 135/68 |
| 4,867,438 | 9/1989 | Steckert et al. . | |

FOREIGN PATENT DOCUMENTS

| | | | |
|---|---|---|---|
| 0313408 | 4/1989 | European Pat. Off. . | |
| 2614994 | 10/1977 | Fed. Rep. of Germany . | |
| 432432 | 3/1948 | Italy . | |
| WO85/05268 | 12/1985 | PCT Int'l Appl. . | |
| 654996 | 3/1986 | Switzerland | 272/70 |
| 1233871 | 5/1986 | U.S.S.R. | 272/69 |

OTHER PUBLICATIONS

Derwent publications, EPO publication abstract 89-124237/17, EPO publication 0 313 408, Apr. 26, 1989.

German patent publication abstract J6766Y/43, German Offenlegungschrift 26 14 944, Oct. 20, 1977.

*Primary Examiner*—Richard J. Apley
*Assistant Examiner*—Jerome Donnelly
*Attorney, Agent, or Firm*—David N. Caracappa

[57] ABSTRACT

An invalid walker is disclosed which includes two vertical members with a horizontal support near the top of the walker. The vertical members are relatively coplanar near the bottom of the walker.

1 Claim, 2 Drawing Sheets

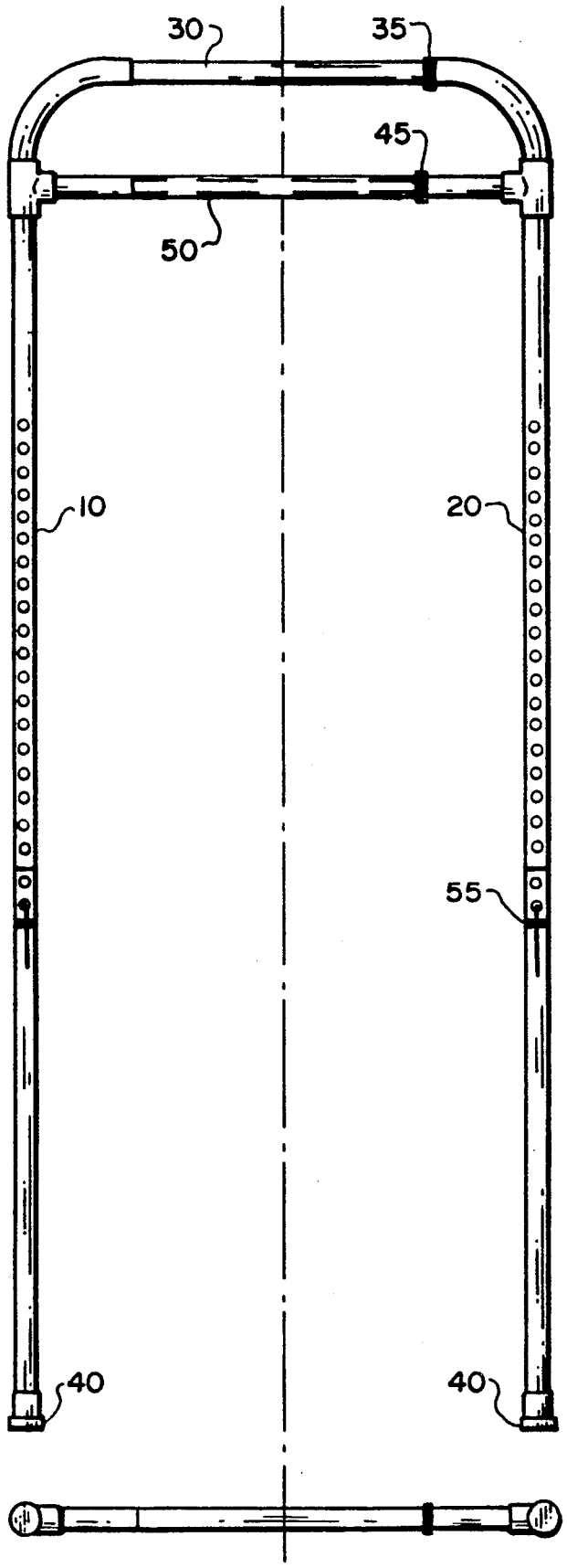
FIG. 1
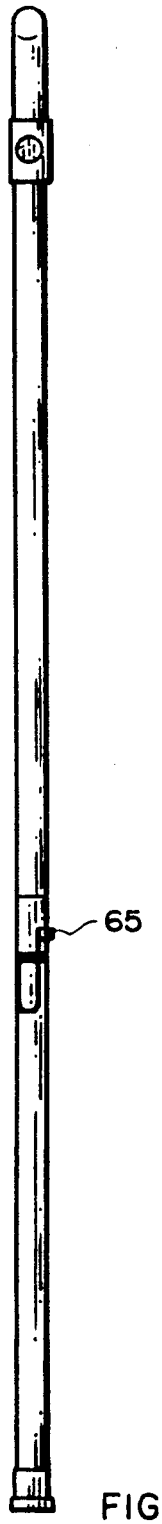
FIG. 2
FIG. 3

WALK-THROUGH WALKER

BACKGROUND OF THE INVENTION

The present invention is related to disclosure document Ser. No. 253,705, entitled WALK-THROUGH CANE, filed Mar. 21, 1990 by Edward N. Harwood. This invention relates to a walker for assisting invalids to walk.

1. Field of the Invention

People with physical infirmities often require devices to aid them in walking. For some more severely affected persons, a single cane is not sufficient support for walking. For such people, walkers (with two or more vertical supports) have been developed. Such people often desire to walk for exercise and to maintain muscle tone to the maximum extent possible. However, existing walking aids often impede the user from taking steps, both on a level way and on stairs.

2. Description of the Prior Art

Examples of existing walkers are described below. U.S. Pat. No. 4,411,283, issued Oct. 25, 1983, to Lucarelli illustrates a walker having four vertical members arranged in a four-sided framework with horizontal supports at the top and bottom of the framework. The front two vertical members are movable up and down in order to allow for ascending and descending staris. U.S. Pat. No. Des. 188,784, issued Sep. 13, 1960 to Campbell illustrates a walker having three fixed vertical members arranged in a triangular framework with a horizontal support at the top. U.S. Pat. No. Des. 291,791, issued Sep. 8, 1987 to Bean illustrates a walker having two vertical members which are arranged to be relatively coplanar (that is, there are no other members extending to the front or back of the walker) with two horizontal supports, one at the top and one at the bottom.

The walker described in Lucarelli is difficult to walk with because it is heavy. The walkers described in both Lucarelli and Campbell are difficult to use on stairs because they are not relatively coplanar near the bottom. The walkers described in both Lucarelli and Bean prevent the user from taking more than one or two small steps before the walker must be moved. It is desirable that a walker allow a user to take several normal steps before being moved, and easily to ascend and descend steps. In addition, a walker should not be so heavy as to make it difficult to move.

SUMMARY OF THE INVENTION

In accordance with principles of the present invention a walker includes two vertical members with a horizontal support near the top of the walker. The vertical members are relatively coplanar near the bottom of the walker.

A walker in accordance with principles of the present invention is light, allowing the user to easily carry it; and it is relatively coplanar, so that it may be easily used on stairs, where there is no room for another vertical member extending to the front or back. In addition, because a walker according to the present invention has a horizontal support only near the top, the user may take several normal sized steps before having to move the walker.

BRIEF DESCRIPTION OF THE DRAWINGS

In the drawings,

FIG. 1 is a front view of a walker in accordance with the present invention;

FIG. 2 is a side view of the walker illustrated in FIG. 1;

FIG. 3 is a top view of the walker illustrated in FIG. 1; and

DESCRIPTION OF THE PREFERRED EMBODIMENTS

Figure 4A:
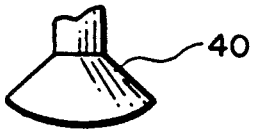
FIGS. 4*a*)–*c*) illustrate alternate feet for the walker illustrated in FIG. 1.

FIG. 1 is a front view of a walker in accordance with the present invention. FIGS. 2 and 3 show side and top views corresponding to the front view illustrated in FIG. 1. In FIG. 1 two vertical members 10 and 20 each have a bottom and a top portion. The bottom portion of the vertical members have non-slip feet 40 installed to prevent slippage of the walker in use. The top portions of vertical members 10 and 20 are connected by a horizontal support 30. Horizontal support 30 may have a soft grip attached to it to make it easier for a user to hold. The height of the vertical members is preferably about as high as the user's breastbone, and the horizontal support is preferably wide enough to allow the user to walk between the vertical members. The walker is preferably made from lightweight metal tubing, such as standard electrical conduit tubing. This tubing may be bent in a known manner to the shape illustrated in FIG. 1.

In FIG. 1, a second horizontal support 50 is illustrated as connecting the vertical members 10 and 20 within a few inches of the top of the walker. The second horizontal support 50 is optional and offers additional rigidity.

In an alternative embodiment, the walker may be made adjustable, both with respect to height and width. For height adjustment, the vertical members 10 and 20 are made in two parts: a top and bottom part. One of the top and bottom parts is made to slide within the other part. In the illustrated embodiment, the bottom part slides within the top part. Two methods are illustrated for fixing the vertical adjustment at a desired height.

A first method of adjusting the height consists of a compression gasket and nut 55 which connects the top and bottom parts of the vertical members 10 and 20 so that the height may be fixed as desired. To adjust the height, the nut 55 is loosened and the bottom part is slid into the top part until the height is as desired. Then, the nut 55 is tightened to prevent further sliding and the height is fixed.

A second method of adjusting the height requires a series of holes to be drilled in the top part of each of the vertical members 10 and 20. A spring loaded button 65 is installed in the bottom part of each of the vertical members 10 and 20, and the button extends into one of the holes drilled in the top part. To adjust the height, the button 65 is pressed and the bottom part is slid into the top part. When the approximate height is reached, the button 65 released and allowed to protrude through the nearest hole in the top section. This prevents further sliding and the height is fixed. Both a compression gasket and nut 55 and a spring loaded button 65 may be used to adjust the vertical height to give more strength.

As illustrated in FIG. 1, for width adjustment, the horizontal support 30, and the optional horizontal support 50 (if present) are divided into two parts with one part made to slide within the other. In the embodiment illustrated in FIG. 1, a compression gasket and nut 35 is installed on horizontal support 30, and a second compression gasket and nut 45 is installed on horizontal support 40. These operate in the same manner as those on the vertical members 10 and 20.

The walker illustrated in FIG. 1 may be used in the following manner. First the non-slip feet at the bottom of the walker are placed on the floor several feet in front of the user's feet. Then, the user may take several normal sized steps through the vertical members of the walker starting from the position where the feet of the walker are in front of the user's feet to a position where the feet of the walker are even with or behind the user's feet, while the walker pivots with respect to the ground around the feet of the walker.

Figure 4B:
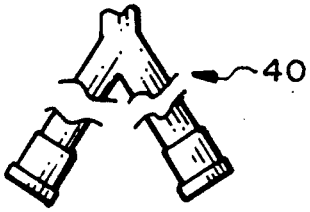
Figure 4C:
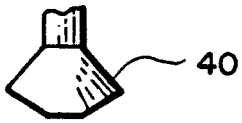

A walker in accordance with the present invention pivots over a larger angle than that of a normal cane or walker—from several feet in front of the user's feet to even with or behind the user's feet. Because of the larger angle, a normal non-slip foot which is used on the normal cane or walker can sometimes slip. FIGS. 4*a*)–*c*) illustrate three embodiments of non-slip feet 40 which minimize slippage over the large angle the walker pivots in normal use. These feet all have bottom portions which are wider than the top portion. The non-slip foot illustrated in FIG. 4*a*) has a curved bottom part. That illustrated in FIG. 4*b*) forms two branches of the vertical member which diverge for a distance of several inches, each branch of which include a standard non-slip foot; and that of FIG. 4*c*) has three flat portions, one facing down, and the other two angled up slightly.

The embodiments illustrated in the Figures are examples of walkers according to principles of the present invention. Other embodiments may also be constructed in accordance with principles of the present invention as set forth in the following claims.

What I claim is:

1. A walk-through walker, consisting essentially of:

first and second non-compressible vertical members each having a top and bottom portion;

a first horizontal support connecting said top portions of said first and second vertical members;

a second horizontal support connecting said first and second vertical members relatively near said first horizontal support;

wherein said first and second vertical members are spaced to allow a user to walk between them, and said first and second vertical members and said first and second horizontal supports are substantially coplanar.

* * * * *